United States Patent [19]

Sommer

[11] Patent Number: 4,662,315

[45] Date of Patent: May 5, 1987

[54] FUEL INJECTION SYSTEM FOR A COMBUSTION CHAMBER OF A RECIPROCATING INTERNAL COMBUSTION ENGINE

[75] Inventor: Bruno Sommer, Winterthur, Switzerland

[73] Assignee: Sulzer Brothers Limited, Winterthur, Switzerland

[21] Appl. No.: 801,095

[22] Filed: Nov. 22, 1985

[30] Foreign Application Priority Data

Feb. 5, 1985 [CH] Switzerland ..... 504/85

[51] Int. Cl.[4] ..... F02D 19/04

[52] U.S. Cl. ..... 123/23

[58] Field of Search ..... 123/446, 447, 23

[56] References Cited

U.S. PATENT DOCUMENTS

| | | | |
|---|---|---|---|
| 2,625,141 | 1/1953 | Berlyn | 123/23 |
| 4,052,963 | 10/1977 | Steiger | 123/23 |
| 4,070,997 | 1/1978 | Steiger | 123/23 |
| 4,601,269 | 7/1986 | Kato | 123/446 |

*Primary Examiner*—Ronald B. Cox

*Attorney, Agent, or Firm*—Kenyon & Kenyon

[57] ABSTRACT

The mechanically driven pump is provided with a delivery chamber which communicates with an annular groove about a valve needle of the injection valve to deliver pressurized hydraulic medium to prevent an inflow of liquid fuel between the valve needle and the injection valve body. The hydraulic pressure medium of the mechanically driven pump also drives a reciprocating piston in the hydraulic pump used to pump the fuel to the injection valve and, thus, also provides a barrier to the passage of liquid fuel between the reciprocating piston and the surrounding wall of the pump.

5 Claims, 2 Drawing Figures

Figure 1:
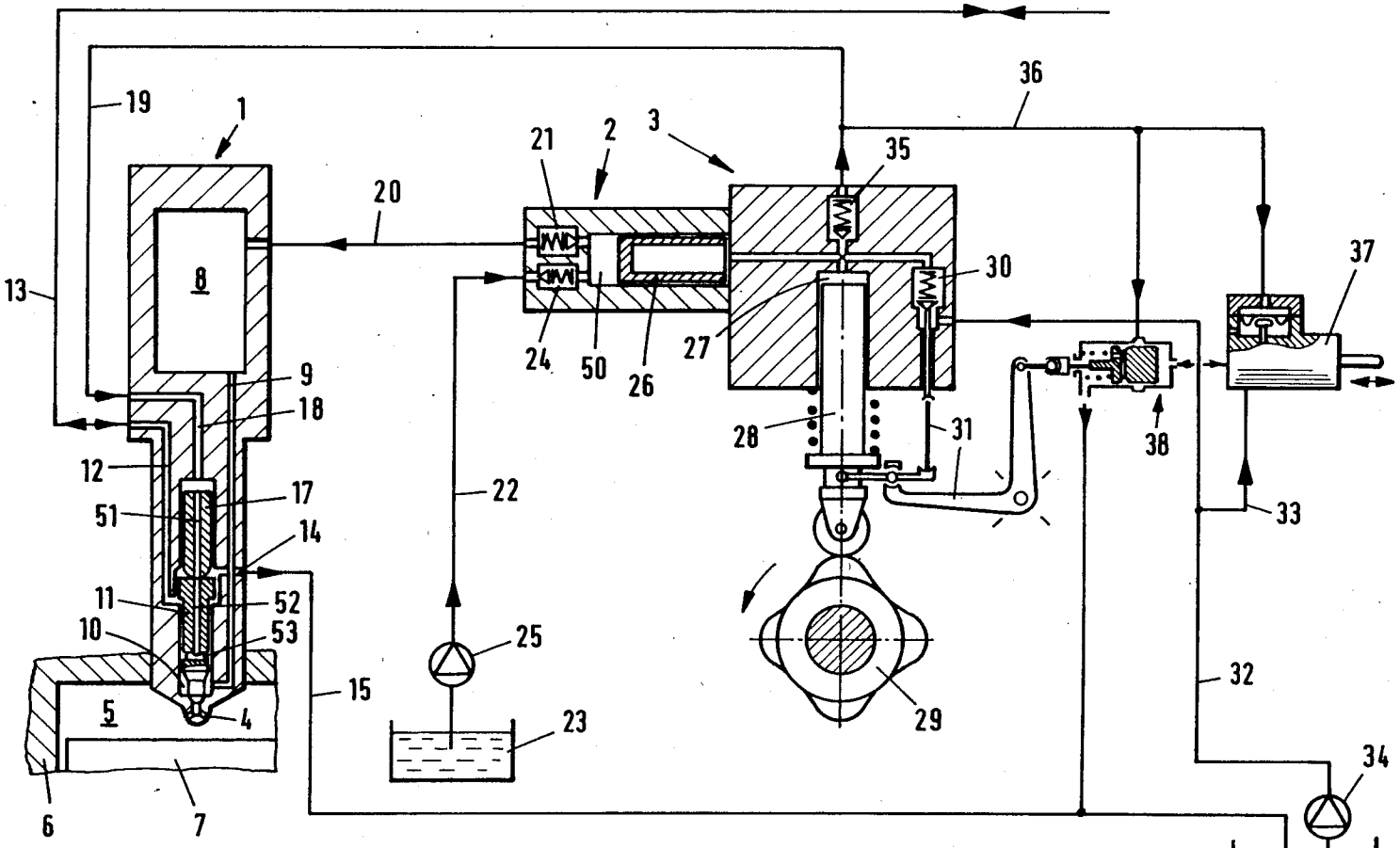

FUEL INJECTION SYSTEM FOR A COMBUSTION CHAMBER OF A RECIPROCATING INTERNAL COMBUSTION ENGINE

This invention relates to a fuel injection system. More particularly, this invention relates to a fuel injection system for a combustion chamber of a reciprocating internal combustion engine.

As is known, use has been made of various types of fuel injection systems for injecting liquid fuels into a combustion chamber of a reciprocating internal combustion engine. Generally, the liquid fuel has been in the form of a suspension of solid finely divided fuel particles in a liquid. For example, liquid fuels of this kind consist, for example, of petroleum coke or coal which has been ground to very fine particles of a size from five (5) to twenty (20) μm and suspended in water and/or oil. Suspensions of this kind are known as slurries.

The conventional system for injecting these liquid fuels has comprised an injection valve and a reciprocating pump which is capable of delivering the liquid fuel to the injection valve. However, these conventional systems run into difficult problems. For example, whenever there are narrow clearances between surfaces which slide or rub on one another, for instance, between a piston and cylinder of the injection pump, between the guiding surfaces of any control valves of the injection pump and between a valve needle and a surrounding bore of an injection valve, fine particles of solid matter tend to penetrate between these surfaces and thus jam the moving parts because of an elevated pressure gradient. A further disadvantage arises due to the abrasion which may occur when the solid particles are harder than the sliding parts.

Accordingly, it is an object of the invention to provide a fuel injection system for a liquid fuel wherein no jamming or abrasion of moving parts may occur.

It is another object of the invention to reduce the wear within a liquid fuel injection system.

Briefly, the invention provides a fuel injection system which is comprised of an injection valve, a hydraulic pump and a mechanically driven reciprocating pump.

The injection valve is constructed with a gallery for receiving a liquid fuel suspension of solid finely divided fuel particles in a liquid under an injection pressure, a valve needle for controlling a flow of liquid fuel from the gallery to a combustion chamber of a reciprocating internal combustion engine and a pressure medium actuated biasing piston for maintaining the valve needle closed in intervals between injection phases.

The hydraulic pump communicates with the gallery of the injection valve for delivering liquid fuel thereto and includes a reciprocable piston.

The mechanically driven reciprocating pump has a delivery chamber for receiving a pressurized hydraulic pressure medium, which chamber is in communication with the piston of the hydraulic pump.

In accordance with the invention, a line communicates the delivery chamber of the mechanically driven pump with an annular chamber about the valve needle for delivering pressurized hydraulic medium to the annular chamber at a pressure greater than the injection pressure of the liquid fuel. In addition, a check valve is connected to and between the delivery chamber and the annular chamber.

The delivery of the pressurized hydraulic medium about the needle valve provides a barrier to a flow of liquid fuel about the valve needle.

In similar manner, driving the piston of the hydraulic pump by the hydraulic medium supplied by the mechanically driven pump ensures that, on the delivery stroke, a pressure gradient is produced which diminishes from the pressure medium to the fuel. In this respect, the hydraulic pressure medium may be a diesel oil or lubricating oil. Consequently, solid particles cannot enter any gap between the piston of the hydraulic pump and the surrounding cylinder wall. Instead, there is a minor loss of pressure medium through leakage. On the intake stroke of the hydraulic pump, the pressure gradient reverses; however, the corresponding pressure difference is considerably less than two hundred (200) bar. This value has been found to be the critical level below which there is no tendency for jamming to occur. Jamming of the pump and abrasion by the solid fuel particles are therefor obviated.

Using an injection valve having a gallery ensures that the fuel pressure in the injection valve remains substantially constant for a given operating state. Similar considerations apply to the pressure medium supplied from the delivery chamber of the mechanically driven pump through the check valve to the annular chamber around the valve needle. Consequently, there is always a minor pressure gradient from the pressure medium to the fuel at the valve needle and there is no need to make any adjustment for this purpose. Consequently, the injection valve cannot be jammed or abraded by solid fuel particles.

Figure 2:
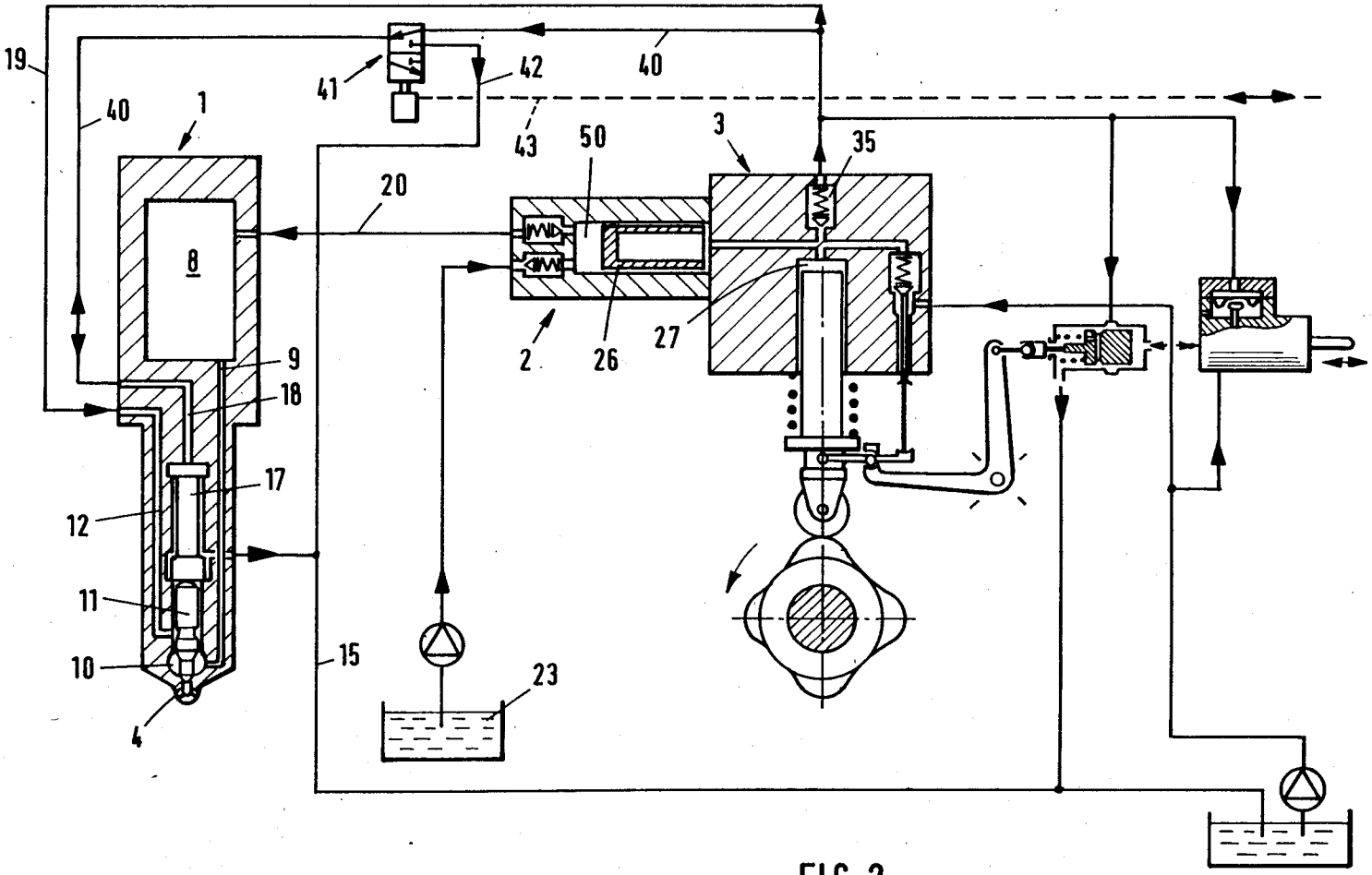

These and other objects and advantages of the invention will become more apparent from the following detailed description taken in conjunction with the accompanying drawings wherein:

FIG. 1 illustrates a diagrammatic view of an injection system constructed in accordance with the invention; and FIG. 2 illustrates a modified fuel injection system according to the invention.

Referring to FIG. 1, the fuel injection system includes an injection valve 1, a hydraulic reciprocating pump 2 and a mechanically driven reciprocating pump 3.

The injection valve 1 has a bottom end, as viewed, which is formed with a number of spray apertures 4 and extends into a combustion chamber 5 of a reciprocating internal combustion engine, i.e. a diesel engine. As indicated, a cylinder 6 and a reciprocable work piston 7 bound the combustion chamber 5.

The valve 1 has a body which defines a gallery 8 for receiving a liquid fuel under an injection pressure of, for example one thousand (1000) bar, when the engine is in operation. The liquid fuel is in the form of a suspension of solid finely divided fuel particles, such as coal in a liquid, such as water or diesel oil. The gallery 8 communicates by way of a bore 9 in the valve body with a chamber 10 in which a valve needle 11 is disposed. The valve needle 11 cooperates with sealing seat in the valve body for controlling a flow of the liquid fuel from a gallery 8 to the combustion chamber 5 via the spray apertures 4. As shown, the valve needle 11 is guided in a bore in the valve body and extends upwardly to a thickened piston-fashioned portion at the upper end. This thickened end is guided in a correspondingly large bore.

The valve body also includes a duct 12 which communicates the bore below the thickened part of the valve needle 11 with a line 13 which leads to a timing pump (not shown).

A duct 14 is also formed in the valve body above the thickened part of the valve needle 11 and extends to a discharge line 15 which leads to a sump or the like 16 which contains a hydraulic pressure medium.

A pressure medium actuated biasing piston 17 is also disposed in the injection valve 1 for maintaining the valve needle 11 closed. As indicated, the piston 17 is guided coaxially of the valve needle 11 in a bore of the valve body. The piston 17 is of smaller diameter than the thickened end of the valve needle 11 but is of greater diameter than the part of the valve needle below the thickened end. In addition, the injection valve body includes a duct 18 which communicates with the upper end of the piston 17 and a line 19 which conveys a pressure medium from the mechanically driven pump 3.

The piston 17 is formed with a continuous axial bore 51 which communicates directly with an axial bore 52 in the upper half of the valve needle 11. This axial bore 52 terminates in a cross-bore 53 in the valve needle which, in turn, terminates in an annular groove in the periphery of the valve needle 11. This annular groove serves to define an annular chmaber about the valve needle 11 for purposes as described below.

As shown in FIG. 1, the injection valve gallery 8 communicates by way of a line 20 and a pressure valve 21 with a delivery chamber 50 of the hydraulic pump 2. In addition, the pump 2 receives a supply of liquid fuel from a supply tank 23 via an intake line 22 in which a feed pump 25 is disposed. As shown, the line 22 connects to an intake valve 24 which leads to the delivery chamber 50 of the pump 2. Of note, each of the valves 21, 24 can be an inherently stable check valve, for example as described in Swiss Patent Application No. 505/85-2 filed Feb. 5, 1985.

As illustrated, the pump 2 includes a reciprocable piston 26 which communicates with a delivery chamber 27 of the mechanically driven pump 3 on the side remote from the valve 21, 24.

The mechanically driven pump 3 includes a piston 28 which is reciprocated via a cam shaft 29 which is drivingly connected to the engine crank shaft in a known manner (not shown) to reciprocate at the cadence of the work piston 7. The cam concerned can be a multiple cam since synchronism with the piston position is not required although such does improve pump capacity. The mechanically driven pump 3 has an intake valve 30 which acts in a known manner by way of a linkage 31 to control the start of delivery pump 3. The intake valve 30 communicates by way of an intake line 32 with the sump or pan or the like 16 to receive a flow of hydraulic medium. As indicated, a feed pump 34 is provided in the line 32.

A check valve 35 is also provided in the pump 3 and connects with the line 19 which extends to the biasing piston 17 of the injection valve 1.

A measuring line 36 is connected to the line 19 while a measuring line 33 is connected to the intake line 32 downstream of the feed pump 34. The two measuring lines 33, 36 extend to a control element 37 which forms a difference between the pressures in the two lines 33, 36 with a hydraulic regulating element 38 which acts on the linkage 31 being actuated in dependence upon the pressure difference measurement. This control adjusts the fuel pressure which is required in the gallery 8 and which varies in dependence upon engine loading.

When the engine is running, hydraulic pressure medium at a pressure of twenty (20) bar taken in by the pump 3 from the line 32 has its pressure increased, as the piston 28 rises, to the higher value of one thousand (1000) bar in the delivery chamber 27. This pressurized hydraulic pressure medium then acts on the piston 26 of the hydraulic pump 2. Consequently, the piston 26 displaces to the left, as viewed, to discharge liquid fuel from the delivery chamber 50 through the check valve 21 and line 20 to the injection valve gallery 8.

The pressure of the fuel in the delivery chamber 50 is below the pressure of the hydraulic pressure medium actuating the piston 26. Consequently, very fine particles of fuel cannot penetrate between the sliding surfaces of the piston 26 and the surrounding cylinder wall and remain there. Hence, there is no risk of the piston 26 jamming.

At the same time, the high pressure medium passes from the delivery chamber 27 through the check valve 35, line 19 and duct 18 to the piston 17 so that the valve needle 11 is kept closed, for example in intervals between injection phases. Also, pressure medium passes through the central bore 51 in the piston 17 and through the bore 52 and cross bore 53 in the valve needle 11 into the annular groove about the valve needle 11. This pressure medium exits closely about the chamber 10 so that, in this region, a pressure difference exists which decreases towards the chamber 10 and thus inhibits any entry of solid particles into the guide bore for the valve needle 11.

The timing pump (not shown) which is connected to the line 13 determines the start and duration of injection and produces a pressure during the injection phase which acts on the underside of the piston-like thickened end of the valve needle 11 and overcomes the closing force of the pressure medium acting on the piston 17. Hence, the valve needle 11 disengages from the valve seat and fuel is injected from the chamber 10, bore 9 and gallery 8 through the spray apertures 4 into the combustion chamber 5.

When the piston 28 of the pump 3 descends, the pressure of the pressure medium in the delivery chamber 27 and on the piston 26 decreases. Hence, the piston 26 returns to the right, as viewed in FIG. 1, and in so doing intakes fuel from the supply tank 23 through the intake line 22 and intake valve 24 into the delivery chamber.

When the pressure on the thickened part of the needle 11 via the line 13 is relieved the pressure on the pistong 17 causes the valve needle 11 to again close.

Referring to FIG. 2 wherein like reference characters indicate like parts as above, the valve needle 11 and biasing piston 17 of the injection valve 1 may be of solid construction. In this case, the duct 12 in the injection valve body communicates with an annular groove in the valve needle 11 and with the line 19 to the check valve 35 of the mechanically driven pump 3. In this way, the line 19 supplies high pressure pressure medium from the delivery chamber 27 of the pump 3 to the annular groove and thus ensures that the pressure therein is slightly higher than the pressure in the chamber 10 to the injection valve so that no solid particles can flow from the chamber 11 to the annular groove.

The duct 18 of the injection valve is connected to a line 40 which is connected by way of an electromagnetically controlled changeover valve 41 to the line 19 downstream of the check valve 35. A discharge line 42 is also connected to the valve 41 and extends to the discharge line 15. A signal line 43 is connected to a signal transmitter (not shown) which is used instead of a timing pump in order to deliver timing signals for the opening and closing of the injection valve 1.

The system illustrated of FIG. 2 operates in a similar manner to the system illustrated in FIG. 1. In this respect, the pump 3 drives the piston 26 of the hydraulic pump 2 and, in so doing, conveys liquid fuel from the tank 23 to the injection valve gallery 8. Also, the pressure medium which has been brought to a high pressure by the pump 3 passes through the line 19 and duct 12 to the annular groove of the valve needle 11. With the changeover valve 41 in the position illustrated, the high pressure medium also passes through the line 40 to the biasing piston 17 to keep the valve needle 11 closed between the injection phases.

At the start of an injection phase, a changeover signal passes through the line 43 to the valve 41. The valve 41 thus rises to an extent such that the branch of the line 40 which is shown on the left in FIG. 2 is connected to the discharge line 42 while the branch of the line 40 which is illustrated on the right in FIG. 2 is closed. Thereafter, the pressure of the pressure medium in the duct 18 drops and the pressure medium acting through the duct 12 in the annular groove of the valve needle 11 moves the valve needle 11 and the piston 17 upwardly. As a result, fuel discharges from the gallery 8, bore 9 and chamber 10 through the apertures 4 of the valve 1 into the combustion chamber (not shown).

At the end of an injection phase, the corresponding signal passes through the line 43 to change the valve 41 back to the illustrated position. Thus, the pressure medium again acts through the line 40 on the biasing piston 17 to close the valve needle 11.

The invention thus provides a fuel injection system wherein the particles of a liquid fuel suspension can be prevented from passing between a valve needle and a bore in which the valve needle reciprocates as well as between a reciprocable piston and a wall of a hydraulic pump which supplies fuel to the injection valve. In this way, the wear of the injection valve as well as the hydraulic pump can be reduced and the life of the components extended.

What is claimed is:

1. A fuel injection system for a combustion chamber of a reciprocating internal combustion engine, said system comprising an injection valve having a gallery for receiving a liquid fuel suspension of solid finely divided fuel particles in a liquid under an injection pressure, a valve needle for controlling a flow of the liquid fuel from said gallery at the combustion chamber, said valve needle having an annular groove therein, and a pressure medium actuated biasing piston for maintaining said valve needle closed in intervals between injection phases;

a hydraulic pump communicating with said gallery for delivering liquid fuel thereto, said pump including a reciprocable piston;

a mechanically driven reciprocating pump having a delivery chamber for receiving a pressurized hydraulic pressure medium, said chamber being in communication with said piston of said hydraulic pump; and a check valve connected to and between said delivery chamber and said annular groove to deliver pressurized hydraulic pressure medium to said groove at a pressure greater than the injection pressure of the liquid fuel.

2. A fuel injection system comprising an injection valve having a gallery for receiving a liquid fuel suspension under an injection pressure; a chamber communicating with said gallery; to receive liquid fuel therefrom and a valve needle in said chamber for controlling a flow of liquid fuel from said chamber;

a hydraulic pump communicating with said gallery for delivering liquid fuel thereto, said pump including a reciprocating piston;

a mechanically driven reciprocating pump having a delivery chamber for receiving a pressurized hydraulic pressure medium, said chamber being in communication with said piston of said hydraulic pump; and a line communicating said delivery chamber of said mechanically driven pump with an annular chamber about said needle for delivering pressurized hydraulic medium to said annular chamber at a pressure greater than the injection pressure of the liquid fuel in said chamber of said injection valve.

3. A fuel injection system as set forth in claim 2 wherein said injection valve includes a piston abutting said valve needle, and a line communicating with said delivery chamber of said mechanically driven pump to receive pressure medium therefrom to maintain said needle valve in a closed position in said injection valve chamber.

4. A fuel injection system as set forth in claim 3 wherein said injection valve needle includes a bore communicating with said annular chamber and said injection valve piston includes a bore communicating with said bore in said valve needle and said line to deliver the pressurized hydraulic medium.

5. A fuel injection system as set forth in claim 4 wherein said annular chamber is an annular groove in said valve needle.

* * * * *